US005582893A

United States Patent [19]

Böttger et al.

[11] Patent Number: 5,582,893

[45] Date of Patent: Dec. 10, 1996

[54] SPACING FABRIC

[76] Inventors: Wolfgang Böttger, Am Künzacker 1, 95361 Ködnitz; Friedrich Hörsch, Wüstenroterweg 21, 89081 Ulm, both of Germany

[21] Appl. No.: 114,515

[22] Filed: Aug. 31, 1993

[30] Foreign Application Priority Data

Aug. 31, 1992 [DE] Germany ..... 42 28 958.0

[51] Int. Cl.[6] ..... B32B 3/02; B32B 3/06; B32B 7/00

[52] U.S. Cl. ..... 428/86; 428/85; 428/102; 428/120; 428/224; 428/246; 428/255; 428/902

[58] Field of Search ..... 428/85, 86, 102, 428/120, 224, 246, 255, 902

[56] References Cited

U.S. PATENT DOCUMENTS

| | | | |
|---|---|---|---|
| Re. 33,923 | 5/1919 | Böttger et al. | 428/113 |
| 3,616,126 | 10/1971 | Tungseth | 428/86 |
| 4,172,916 | 10/1979 | Watson | 428/86 |
| 4,409,271 | 10/1983 | Pehr | 428/86 |
| 4,818,580 | 4/1989 | Böttger et al. | 428/113 |
| 4,840,828 | 6/1989 | Böttger et al. | 428/101 |
| 4,906,502 | 3/1990 | Rudy | 428/86 |
| 4,931,345 | 6/1990 | Böttger et al. | 428/224 |
| 5,240,533 | 8/1993 | Böttger et al. | 428/257 |

*Primary Examiner*—Terrel Morris
*Attorney, Agent, or Firm*—Martin A. Farber

[57] ABSTRACT

A spacing fabric (3), in particular velour fabric, which spacing fabric has a first and second layer (4, 5) and intermediate webs (7) connecting these layers (4, 5) and is made of a technical yarn like aramide fibre, carbon fibre, ceramic fibre, or, in particular, glass fibre, with a resetting force inherent to the intermediate webs (7) which tends to automatically keep the layers (4, 5) of the spacing fabric (3) apart, especially also after resinification. The invention proposes that, in order to control the spacing of the layers of the spacing fabric, the layers (4, 5) of the spacing fabric (3) be attached to one another so that they can be detached.

10 Claims, 3 Drawing Sheets

SPACING FABRIC

FIELD AND BACKGROUND OF THE INVENTION

This invention concerns a spacing fabric, in particular velour fabric, which spacing fabric has a first and second layer and intermediate webs connecting these layers and is made of a technical yarn like aramid fiber, carbon fiber, ceramic fiber, or, in particular, glass fiber, with a resetting force inherent in the intermediate webs which tends to automatically keep the layers of the spacing fabric apart, especially also after resinification.

For example, such a spacing fabric is known from European patent application EP-A3 0 299 308 (corresponding to U.S. Pat. No. 4,840,828) or rather is the basis for the structural component described there. In addition, German patent application DE-OS 38 13 741 is also referred to. If such a spacing fabric is impregnated to a specific extent with resin and, if necessary, excessive resin is subsequently squeezed out again, the intermediate webs are automatically and spontaneously reset, so that there is a space between the first and second layers.

Such spacing fabrics and structural components manufactured from them are already used in various applications. For example, hollow bodies are manufactured from them or, in particular, they are used to reinforce the internal or external walls of existing hollow bodies, for example tanks containing liquids. They are also used in the flooring industry.

In regard to reinforcement, the invention is useful, in particular, where only sections of a sheet metal plate or the like which is to be reinforced, are combined with the spacing fabric. However in this regard there is the danger that media, which can flow over the edge regions, for example water, oil, or also paint, can penetrate between the layers, so that the spacing fabric can become totally impregnated with the liquid. However, often this application of the free-flowing media occurs at a specific time during the treatment-fabrication of the sheet metal which is reinforced by the spacing fabric.

SUMMARY OF THE INVENTION

Based on the state of the art described above, one object of the invention is to provide a spacing fabric which, especially when used to reinforce flat structural components, for example sheet metal plates, provides the desired reinforcement of the sheet metal or other structural component to which it is applied, without the above-mentioned detrimental effects which occur upon a treatment with a liquid (an intermediate treatment) of the structural component as a result of its hollow body structure present in the hardened state.

This object of the invention is achieved by the layers of the spacing fabric being attached (held) to one another so that they can be detached (released). In accordance with the invention it has been found that the hollow body structure of a hardened, resinified structural component based on a spacing fabric, such as considered here, is only detrimental upon use if the spacing fabric is already present in the hollow body structure with the layers spaced from each other during the application of the liquid to the structural component. The liquid may be paint, for example. Due to the fact that in accordance with the invention the layers of the spacing fabric are detachably attached (held) to one another, the invention makes it possible, however, that at first the layers of the spacing fabric, i.e. during the application of the liquid, lie on one another such that there is no hollow space between the layers which could become completely impregnated with liquid, for example, paint.

It is only after the application of the liquid is terminated, for example a coat of paint has been applied, that the resetting force of the intermediate webs is to be released (activated), i.e. the attachment between the layers of the spacing fabric is released (detached). In principle, many ways are suitable for this purpose. For example, one could proceed by installing metal parts in both layers of the spacing fabric, or at least the external layer, which makes it possible for example to draw (or if necessary also to press) the external layer magnetically to the internal layer, i.e. directly to the layer of the spacing fabric on the sheet metal plate. If the magnet were turned off, the resetting force of the intermediate webs would be released (activated) and the structure of the spacing fabric would adjust, holding to the reinforced structural component, for example a thin sheet metal plate.

The invention makes use of the well known strength of a rigid spacing fabric to provide dimensional stability to a workpiece, such as a metallic plate, by reinforcing the plate with the fabric. It is recognized by the invention that, in order to facilitate the manufacture of a reinforced object, be it a flat plate or a container such as a tank, it is desirable to secure the fabric to the workpiece while the layers of the fabric are still in a compact (attached) yet flexible form without hollow spaces therein, prior to the expansion of the fabric and hardening treatment of the fabric as by resinification, to attain its rigidity. The invention permits the use of the compact flexible fabric in the manufacturing process by constructing the fabric with pile or link threads which extend between a first layer and a second layer of the fabric. In accordance with a feature of the invention, the pile or link threads have an inherent spring (resetting) force which urges the two layers apart. Thereby, after the fabric has been located in a desired position relative to the workpiece and after any necessary application with a liquid e.g. paint, the attachment of the layers of the fabric is released so that the fabric expands under the influence of the spring force to space apart the two layers as required for a spacing fabric. The spring force is operative even in the presence of a resin disposed on the link fibers. After a curing of the resin, the link fibers retain the spaced apart relation of the two fabric layers. Initially, some form of holding mechanism is employed to hold the layers of the fabric in compact (attached) form, which holding mechanism is subsequently disabled to permit the expansion. For example, the holding mechanism may be a fusible thread which is destroyed by heating, or a stiff coating of resin which becomes flexible upon heating or the metal parts in the layers which can be attracted magnetically.

Within the framework of the invention it is preferred that the attachment of the layers of the spacing fabric to one another be released by the application of heat. In this case the production process is utilized in an appropriate manner especially during lacquering. First, the lacquer is applied to the part to be lacquered. Then, as a rule, in order to dry the color coat, the part is subjected to heat treatment in an oven, for example at temperatures above 100° C. As the lacquer still has a certain liquidity, or rather viscosity, before being put into the oven, the spacing fabric can easily restore itself to the desired form if as a result of the resulting application of heat in the oven the resetting forces of the intermediate webs are released (activated). Regarding the release of the attachment by means of the application of heat, there are also various possibilities in the technical design. For example, the resin with which the spacing fabric is impregnated could itself be adapted in such a way that it is adhesively firm at room temperature but at a higher temperature, for example between 50° and 100° C., but in particular at temperatures above 100° C., it passes through a low viscosity state of reduced adhesiveness before it hardens at higher temperatures, in this example far above 50° to 100° C. (or it hardens as a result of being stored for a long period). Within the framework of the invention it is first preferred that the layers of the spacing fabric be attached or sewn to one another by means of a fusible thread. This has proven itself to be a measure which can be implemented advantageously in processing the spacing fabric efficiently insofar as the releasability of the attachment of the layers is concerned. For example, copolyamides and copolyesters are known as such fusible threads, also called hot melt yarn. In addition, fusible threads based on polyethylene monofilaments may also be used. The layers can be sewn to one another by means of the fusible threads or alternatively, can be pinned or tufted for example. As another alternative method of attaining the releasable attachment of the layers of the spacing fabric to one another, it is also possible to coat individual threads of the spacing fabric or threads separately inserted into the spacing fabric with a glue which loses or reduces its adhesion at a specific temperature. In this way, a customary resin suitable for resination and hardening could be used during resinification of the spacing fabric, but the attachment of the layers to one another is attained by means of separate adhesive threads which only need to be adjusted in such a way that they lose or greatly reduce their adhesiveness when a specific temperature is exceeded.

The invention also concerns a spacing fabric, as in the form of a prepreg spacing fabric preimpregnated with resin, which is formed in accordance with one of the individual measures explained above. As is known, prepregs are defined as sheets preimpregnated with hardenable synthetic resins which are processed to shaped parts or semi-finished products by means of hot pressing or, in any case, the application of heat. Reaction resin compounds based on epoxy resin, unsaturated polyester resins and, for example, polydiallylphthalate are primarily used as binders in this case. In principle, such resins can also be considered for the impregnation of the spacing fabrics of the invention. Prepregs manufactured in this way are kept in cold storage, preventing the setting and, therefore, hardening of the resin. For processing, the prefinished mats or other blanks are taken out of the cold storage area and, for example, rolled or laid on structural components, on which they harden at room temperature. This process can also be accelerated by the application of heat.

In addition, the invention also concerns a process to lacquer a thin structural component, for example a sheet metal plate, equipped with a reinforcing element. In order to avoid any undesired accumulation of paint, the invention provides that the structural component is combined with a self-resetting spacing fabric whose resetting force is cancelled, in a releasable manner so it can be activated, and that the resetting force of the intermediate webs of the spacing fabric is released (activated) by means of a subsequent heat treatment. The releasable attachment of the layers of the spacing fabric can be carried out in accordance with one of the measures described above.

BRIEF DESCRIPTION OF THE DRAWINGS

With the above and other advantages in view, the present invention will become more clearly understood in connection with the detailed description of preferred embodiments, when considered with the accompanying drawings, of which.

DETAILED DESCRIPTION OF THE PREFERRED EMBODIMENTS

Figure 1:
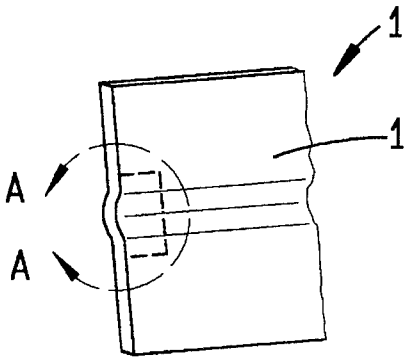
FIG. 1 is a diagrammatic illustration of a thin-walled sheet metal structural component which is combined on one side with a spacing fabric as a reinforcing element.
Figure 1A:
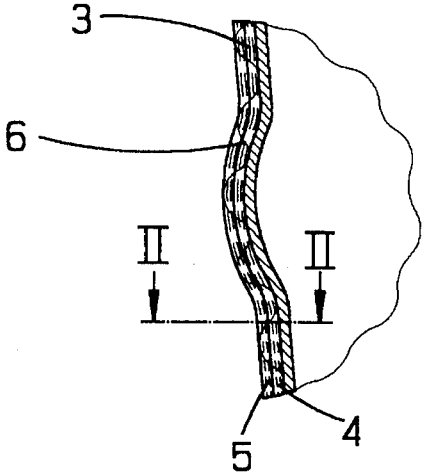
FIG. 1*a* is an enlarged detail of the portion A—A in FIG. 1 of the structural component combined with the spacing fabric, with the layers of the spacing fabric being attached to one another.

First, a thin-walled sheet metal structural component 1, on the basis of which the invention is explained, is illustrated and described in FIG. 1.

A spacing fabric 3 with layers 4, 5 attached to one another is applied, specifically glued, to the inside of the structural component 1 of a door 10 (see arrow).

The spacing fabric 3 is woven as velour fabric.

Figure 1B:
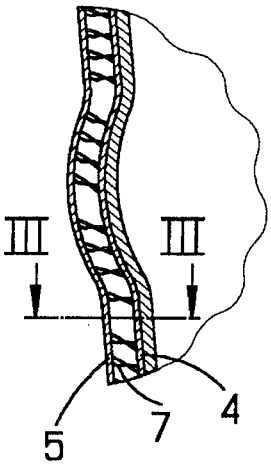
FIG. 1*b* is an illustration in accordance with FIG. *a* after the release (activation) of the resetting force of the intermediate webs of the spacing fabric.
Figure 3:
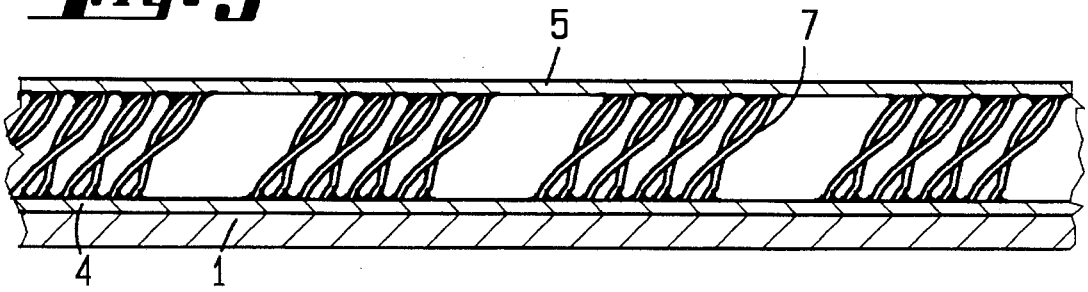
FIG. 3 is an illustration in accordance with FIG. 2 after releasing the attachment of the layers to one another and hardening of the structural component.
Figure 5:
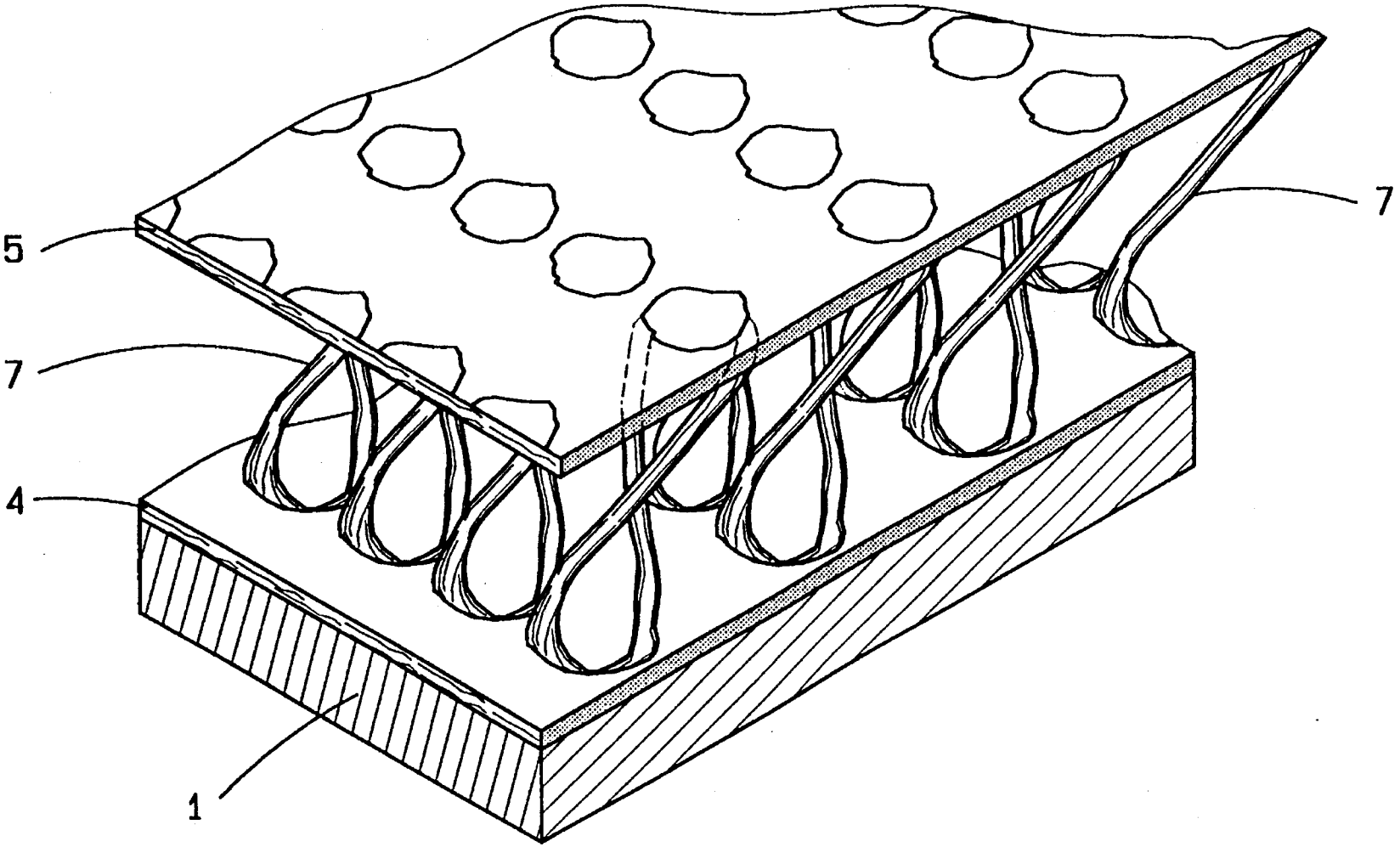
FIG. 5 is a diagrammatic perspective illustration of the structural component with combined spacing fabric in hardened form with the layers separated from one another.

Furthermore, the spacing fabric is impregnated with a hardenable resin such that it resets itself if the attachment of the layers 4, 5 to one another is released and hardens with the layers 4, 5 being spaced a distance from one another as is illustrated diagrammatically in FIGS. 1*b*, 3, and 5.

The layers 4, 5 of the spacing fabric 3 woven from glass fiber in the illustrated embodiment are attached to one another by means of fusible threads 6. The fusible threads 6 are merely indicated diagrammatically. The illustration does not correspond to the course of fusible threads 6 such as results when the layers 4, 5 are sewn in or sewn up opposite to one another by means of these fusible threads 6. The individual fusible threads 6 comprise a so-called hot melt yarn based on copolyamides. It is also possible, however, to make these hot melt yarns on a copolyester or polyethylene monofilament basis.

The fusible threads 6 are released during the heat treatment regularly provided after the lacquering procedure in the production process of such structural components 1, so that the layers 4, 5 are no longer attached to one another. The intermediate webs 7 then reset themselves in the form evident in FIGS. 1*b*, 3, and 5 for example. For more details, reference is also made here to European patent application EP-A3 0 299 308 (corresponding to U.S. Pat. No. 4,840,828) already mentioned at the beginning, whose disclosure contents are also included totally in the disclosure of this application, thereby being incorporated by reference herein.

Figure 2:
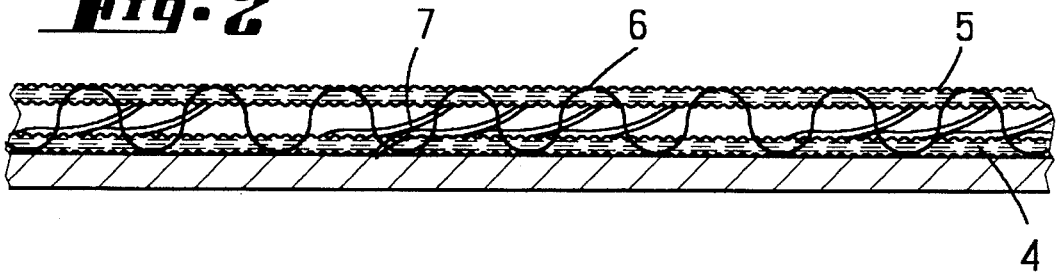
FIG. 2 is a diagrammatic illustration of the spacing fabric combined with the structural component, with the layers being attached to one another.

The illustration of the intermediate webs 7 in FIG. 2 is only to be understood as purely diagrammatic. In fact, in a real design, layers 4, 5 are considerably closer to one another or lie on one another as a result of the attachment produced by the fusible threads 6. It is only for illustrative purposes that a certain space has been left here between the layers 4, 5.

Figure 4:
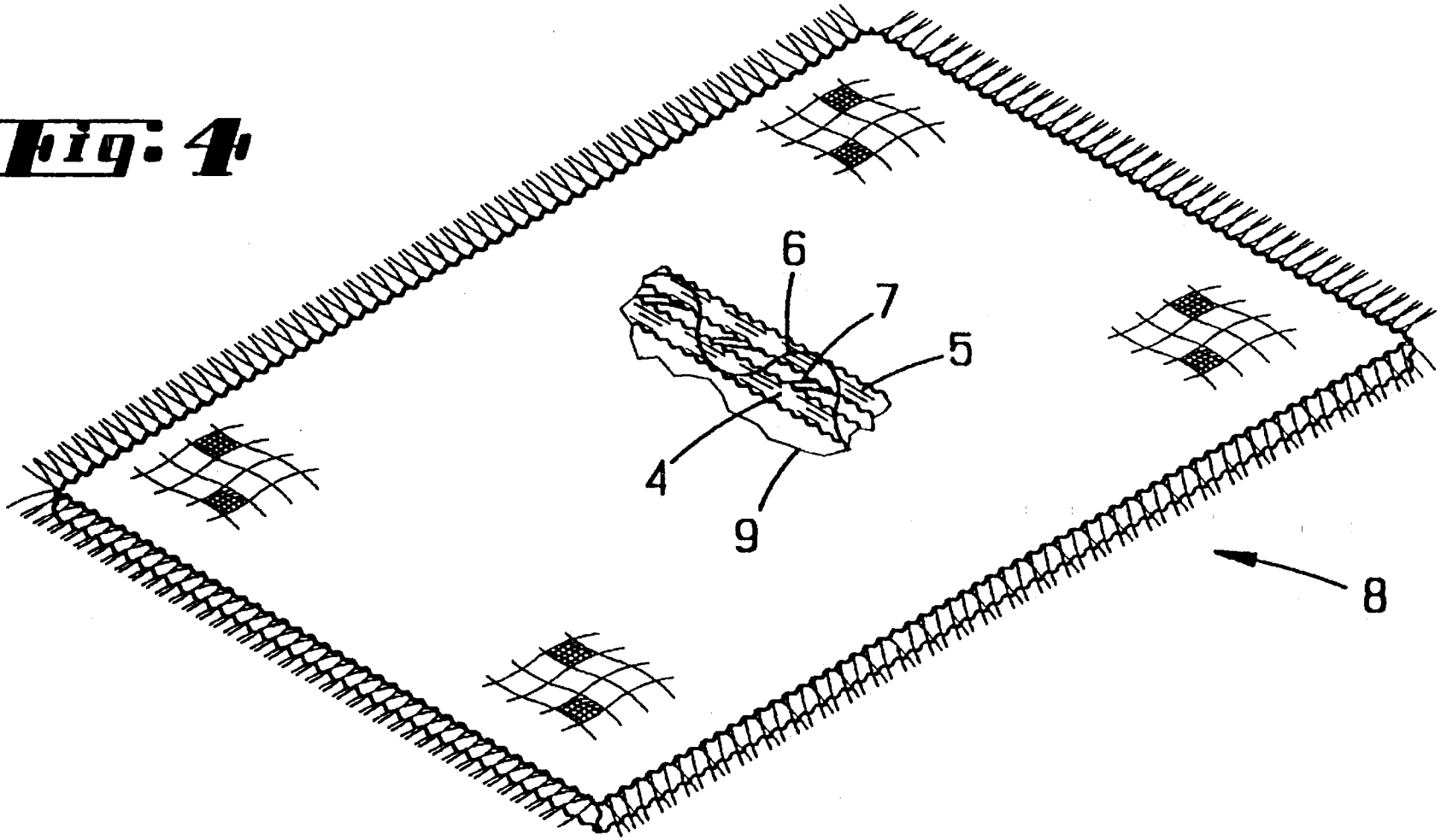
FIG. 4 shows a spacing fabric with layers attached to one another so that they can be detached, illustrated diagrammatically as a prepreg.

A spacing fabric, based on a prepreg 8, is illustrated in FIG. 4 in a diagrammatic manner. The opening 9 shows that the prepreg comprises two (in any case at least two) layers 4, 5 of a spacing fabric which lie on top of one another and which are attached to one another by means of fusible threads 6 in such a way that the resetting force of the intermediate webs or pile threads 7 is cancelled and is only released (activated) after the fusible threads are released in such a way that the intermediate webs 7 straighten up producing a space between the layers 4, 5.

As is shown especially in the illustrations in FIGS. 3 and 5, in the hardened state there is a three-layer sandwich-like composite of the structural component 1, layer 4, and layer 5 of the spacing fabric with the interposition of the intermediate webs 7. As the layer 4 is bound by means of a firmly adhering industrial glue which hardens at room temperature, an undetachable composite and a statically highly deflection-resistant sandwich structure is created. This is assisted by the twisting of the individual intermediate webs 7 and the attachment of the threads, which the intermediate webs 7 form in a middle range for example, through their figure-eight structure. For more details, reference is made once again to EP-A3 0 299 308 referred to above.

We claim:

1. A spacing fabric made of fibers selected from the group consisting of aramid fibers, carbon fibers, ceramic fibers and glass fibers; the spacing fabric comprising:

a first fabric layer and a second fabric layer;

a plurality of intermediate links of technical yarn extending from said first layer to said second layer, each of said links having a spring force for holding said second layer spaced apart from said first layer;

wherein said fabric is resinified with a heat hardenable resin and holding means are provided which overcome said spring force so that said second layer is held on said first layer with the resin in an un cured state such that said first and second layers are contacting; and wherein said holding means is temperature sensitive such that, upon a raising of temperature of the spacing fabric, said holding means is disabled allowing said second layer to separate into a spaced apart relation from said first layer in response to the spring force of the intermediate links, said raising of the temperature and a subsequent lowering of the temperature being operative to cure said resin for maintaining said first and said second layer in the spaced apart relation.

2. The spacing fabric in accordance with claim 1, wherein said holding means provides for attachment of said first layer to said second layer, and the attachment of said first and said second layers is releasable by the application of heat.

3. The spacing fabric in accordance with claim 1, wherein said holding means comprises a fusible thread.

4. The spacing fabric in accordance with claim 3, wherein said first and said second layers are pinned to one another by means of said fusible thread.

5. The spacing fabric in accordance with claim 1, wherein said holding means comprises an adhesive coated to individual threads of the spacing fabric or threads inserted into the spacing fabric and having an adhesiveness which disappears totally or is reduced at a specific temperature.

6. The spacing fabric in accordance with claim 1, wherein said holding means includes said resin with which the spacing fabric is totally impregnated, said resin releases the spring force of said intermediate links in a state of reduced adhesiveness occurring prior to a hardening of said resin, and upon an increase of temperature.

7. The spacing fabric according to claim 1, wherein the fabric is in the form of a prepreg with a spacing fabric preimpregnated with resin.

8. The spacing fabric in accordance with claim 1, wherein said holding means comprises a fusible thread, and said first and said second layers are sewn to one another by means of said fusible thread.

9. The spacing fabric in accordance with claim 1, wherein said holding means comprises a fusible thread, and said first and said second layers are tufted to one another by means of said fusible thread.

10. A spacing fabric made of fibers selected from the group consisting of aramid fibers, carbon fibers, ceramic fibers and glass fibers; the spacing fabric comprising:

a first fabric layer and a second fabric layer;

a plurality of intermediate links of technical yarn extending from said first layer to said second layer, each of said links having a spring force for holding said second layer spaced apart from said first layer, said fabric being resinified with a heat hardenable resin;

holding means that overcome said spring force and hold said second layer in contact with said first layer during an uncured state of said resin; and wherein said holding means is temperature sensitive such that, upon a raising of temperature of the spacing fabric, said holding means is disabled allowing said second layer to separate into a spaced apart relation from said first layer in response to the spring force of the intermediate links, said raising of the temperature being operative to cure said resin for maintaining said first and said second layer in the spaced apart relation.

* * * * *